US005134571A

United States Patent [19]

Falque et al.

[11] Patent Number: 5,134,571

[45] Date of Patent: Jul. 28, 1992

[54] CONTROLLED CABLE TRANSPORT INSTALLATION

[75] Inventors: Alain Falque, Grenoble; Bengt Asberg; Christophe Bottollier, both of Annecy-Le-Vieux, all of France

[73] Assignee: Von Roll Transportsysteme Ag, Thun, Switzerland

[21] Appl. No.: 461,239

[22] Filed: Jan. 5, 1990

[30] Foreign Application Priority Data

Jan. 9, 1989 [FR] France ..... 89 00462

[51] Int. Cl.[5] ..... B61B 12/06; B65G 23/00

[52] U.S. Cl. ..... 364/478; 198/502.1; 198/323; 198/329; 104/173.1

[58] Field of Search ..... 364/478; 198/502.1, 198/502.4, 323, 329; 104/173.1, 173.2

[56] References Cited

U.S. PATENT DOCUMENTS 3,809,832 5/1974 Burger ..... 200/61.13 X
4,003,314 1/1977 Pearson ..... 104/173.2 X
4,470,355 9/1984 Kunczynski ..... 104/196
4,508,205 4/1985 Aulagner et al. ..... 198/323
4,522,285 6/1985 Salmon et al. ..... 104/196 X
4,782,761 11/1988 Asberg ..... 104/173.1 X

*Primary Examiner*—Jerry Smith
*Assistant Examiner*—Allen M. Lo
*Attorney, Agent, or Firm*—Ratner & Prestia

[57] ABSTRACT

A controlled tension cable transport system is disclosed, comprising a pulley with fixed axis and a second pulley whose axis occupies a position which is normally fixed during operation. Four sensors measure the tension of the cable during a previous test phase, with the installation off load, and a computing and control assembly compares the measurement results obtained with admissible limit values, for allowing or preventing operation of the installation. Preferably, the computing and control assembly permanently compares the tension of the cable and the torque of the pulley with respect to admissible threshold values during operation of the installation.

16 Claims, 8 Drawing Sheets

CONTROLLED CABLE TRANSPORT INSTALLATION

BACKGROUND OF THE INVENTION

The present installation relates to cable transport systems in which a closed loop formed of a carrier-tractive cable or tractive cable travels over a first pulley and a second pulley, one at least of these two pulleys driving and being driven by a motor controlled by a control means. In known installations, the shaft of the first pulley is fast with a first fixed frame of the installation and the shaft of the second pulley is retained by a second fixed frame of the installation at a distance from the first fixed frame. Transport members are attached to the cable to be driven by said cable between the first fixed frame or first station and the second fixed frame or second station of the installation.

Cable installations are often used for transporting passengers, particularly in mountain regions, and comprise a lower station and an upper station, the stations being remote from each other. The distances frequently met with often exceed 500 to 1000 meters. During use of the installation, the cable is subjected to relatively high temperature variations, which may produce not inconsiderable length variations. In addition, the cable is subjected to relatively high tractive forces, which may cause progressive creep under tensile stress in time, mainly at the beginning of the period of use of a new cable.

So that installations may maintain more or less constant tension of the cable, despite the progressive creep of the cable in time and the temperature variations, use is very often made of a counterweight. In this case the shaft of the second pulley is mounted on a carriage which is mobile with respect to the second fixed frame and retained by a counterweight.

In some recent installations, the counterweight has been replaced by jacks or self-acting jacks for regulating the cable tension and thus fulfilling the same functions as a counterweight.

Such known installations however have numerous drawbacks and particularly:

very often the counterweight is made from concrete or other different materials and its weight is never known accurately;

during operation, the dynamic effects due to the inertia of the counterweight or the means controlling the jack create sometimes overloads and sometimes uncontrolled underloads;

the pressures for driving the jacks are difficult to control, particularly under dynamic operating conditions;

the means for controlling and driving the jacks lack rapidity and thus create uncontrolled dynamic effects;

installations with counterweights or jacks require relatively complex mechanical elements which substantially increase the cost of the installation.

SUMMARY OF THE INVENTION

The object of the present invention is to avoid the drawbacks of known counterweight or jack installations by providing a new installation structure comprising neither counterweight nor jack for regulating the cable tension. The result is that the installation is considerably simplified and the imperfections due to ignorance of the weight of the counterweight or the driving pressure of the jacks and the harmful effects of counterweight or jacks are avoided during transitory conditions.

The present invention is particularly well adapted to new cable technologies which produce cables in which the variations of length because of the temperature are much smaller and in which the creep is considerably reduced, even practically non existent. During use of such a cable, it then becomes possible to further simplify the installation and considerably lower the cost thereof.

An object of the present invention is also to increase the operating safety of the installation by using means for permanently checking and rapidly detecting malfunctions, so as to warn the operator or rapidly force shut-down of the installation.

To attain these objects as well as others, the installation of the invention comprises:

retention means for maintaining the shaft of the second pulley on its second fixed frame of the installation in a substantially constant position during the whole of the working of the installation, means for measuring the tension exerted by the cable on said second pulley, these means producing a signal which is the image of said tension, the signal being fed to the input of a computing and control assembly, the computing and control assembly receiving the signal produced by the tension measurement means permanently compares the signal, during operation of the installation, with a predetermined minimum and maximum threshold, and produces at its output an alarm signal when the tension measurement signal is short of the minimum predetermined threshold or in excess of the maximum predetermined threshold. Preferably, the computing and control assembly further produces at its output a shut-down signal fed to the drive means so as to cause shut-down of the installation when the tension exerted by the cable on the second pulley is outside the limits set by the predetermined minimum and maximum thresholds.

In an advantageous embodiment, the installation further comprises means for measuring the torque on the second pulley, said second pulley being then driving; the result of the torque measurement is fed to the computing and control assembly which compares the torque measured with an adherence threshold and which produces a shut-down or alarm control signal when the torque exceeds the adherence threshold.

In a practical embodiment, the second pulley is mounted for rotation on an independent carriage sliding longitudinally on guides of the second fixed frame substantially parallel to the mean traction direction of the cable. The carriage is retained by retaining stop means of the fixed frame limiting its longitudinal movement against the tractive force exerted by the cable. At least one force sensor is inserted in the chain of elements between the second pulley and the second fixed frame for measuring the carriage retaining force exerted by the retaining stop means, the force sensor producing the image signal of the tension of the cable, this signal being fed to the computing and control assembly.

In a preferred embodiment for simultaneously measuring the torque, the carriage is retained by two stops offset laterally with respect to each other with respect to the mean longitudinal direction of the cable, or mean direction of the two sides of the cable leaving the pulley, the carriage being guided by vertical guide means on the second fixed frame allowing lateral movement and pivoting thereof parallel to the plane defined by the two cable sides leaving the pulley; a first force sensor is disposed on the first stop; a second force sensor is disposed on the second stop; the signals produced by the two force sensors are fed to the computing and control assembly so as to determine the overall tension of the cable from the sum of the signals from the two sensors; each of the two signals makes it possible to determine the respective tension of the two cable sides and from the difference of the two signals the torque can be determined.

With the above described solution, the tension of the cable can be checked and it can be verified whether it is situated within the limits in which there is no fear of exceeding the maximum tension given by the regulation safety coefficient, and in which there is no fear of loss of adherence of the cable on the drive pulley.

The invention further makes it possible to anticipate the reactions of the installation and to warn the operator so as to incite him to intervene on the installation, for example by shortening the cable or changing or adapting other parts of the installation as a function of the checking results.

For that, during a test phase carried out under predetermined load conditions, for example offload, the computing and control assembly compares the tension exerted by the cable on the pulley with two maximum and minimum limit values, the limit values being chosen by computation so that the installation may operate normally under appropriate safety conditions, without loss of adherence and without exceeding the safety coefficient of the cable, during the operating phase which follows the test phase, on the usual operating assumptions. The computing and control assembly then delivers a signal allowing operation or inhibiting operation after the test comparison. It will be readily understood that, during the test phase, the two maximum and minimum cable tension limit values are closer than the maximum and minimum thresholds used at the time of permanent checks taking place during the above operating phases.

During the test phase, the ambient temperature may be advantageously taken into account which is measured by a temperature sensor whose signal is delivered to the computing and control assembly which takes it into account for the comparison. Thus, the range defined by the overall tension limit values may be determined with greater accuracy, and may be reduced.

In an improved embodiment, the installation further comprises means for adjusting, during the test phase, the longitudinal position of the carriage supporting the second pulley with respect to the second fixed frame, said carriage being held fixedly in the position chosen during the subsequent working phase. The adjustment of the longitudinal position of the carriage makes it possible to accommodate considerable creep of the new cable at the beginning of use.

BRIEF DESCRIPTION OF THE DRAWINGS

Other objects, features and advantages of the present invention will be clear from the following description of particular embodiments, with reference to the accompanying drawings, in which.

DESCRIPTION OF THE PREFERRED EMBODIMENTS

Figure 1:
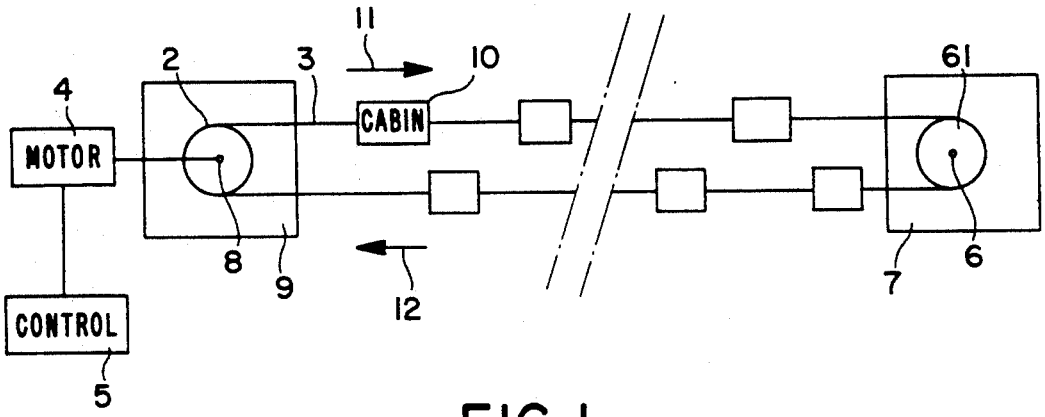
FIG. 1 shows schematically a cable transport installation in a top view.

As shown in FIG. 1, a cable transport installation in accordance with the invention comprises a first pulley 61 and a second pulley 2, about which passes a closed cable loop 3, carrier-traction cable of traction cable. Pulley 2 is driving and is driven by a motor 4 such as an electric motor, controlled by motor control means 5. The shaft 6 of the first pulley 61 is fast with a first fixed frame 7 of the installation. Shaft 8 of the second pulley 2 is retained by a second fixed frame 9 of the installation. Transport members 10, for example one or more buckets, cabins or one or more seats, are attached to cable and are driven in movement by said cable 3, as shown by arrows 11 and 12, between the first station formed by the first fixed frame 7 and the second station formed by the second fixed frame 9.

In FIGS. 2 to 7 the connecting structure between the second pulley 2 and the second fixed frame 9 have been shown. The second pulley 2, in the embodiment shown, is fast with a vertical shaft 8 driven by motor 4 and a reducer 13, the assembly being mounted on a carriage 14. Carriage 14 is an independent carriage sliding longitudinally on two lateral guides 15 and 16 fixed to the second fixed frame 9. By longitudinal direction, such as the direction of guides 15, 16, is meant the mean traction direction of cable 3. Generally cable 3 is formed of two parallel sides connecting the two pulleys 61, 2 together, as shown in FIG. 1, the sides then being both in the longitudinal direction. Carriage 14 is retained by retention stop means carried by the fixed frame, limiting its longitudinal movement against the tractive force exerted by the cable.

Figure 6:
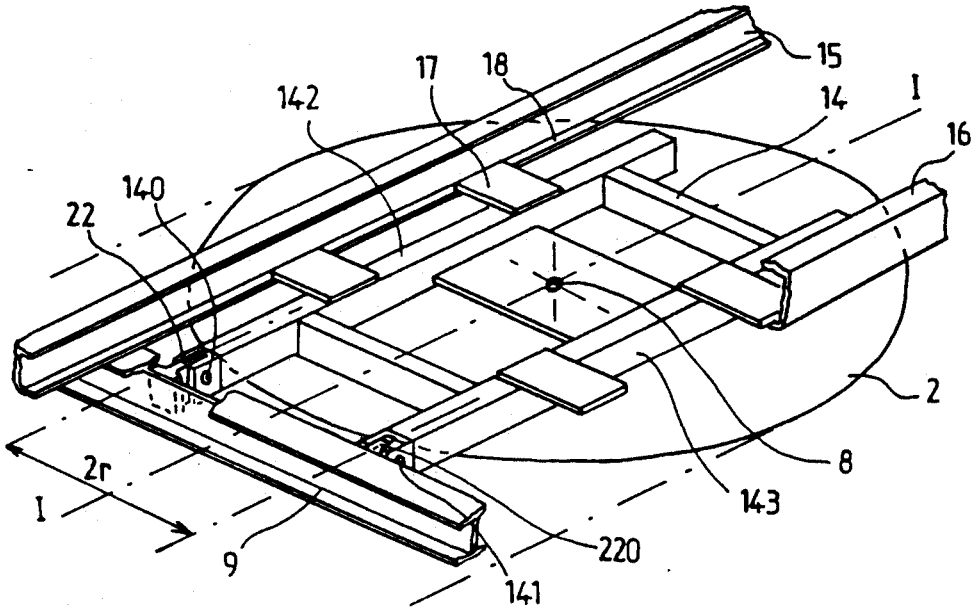
FIG. 6 is a schematic partial view in perspective of the support means for the drive pulley in a first embodiment of the invention.

In the embodiment shown in FIG. 6, carriage 14 comprises lateral sliding lugs such as lug 17, bearing slidingly on corresponding profiles 18 of the guides such as guide 15. Guides 15, 16 guide the carriage 14 vertically while allowing it to move longitudinally and oscillate slightly transversely. The longitudinal movement of carriage 14 and the transverse oscillation are balanced by stop means.

Figure 7:
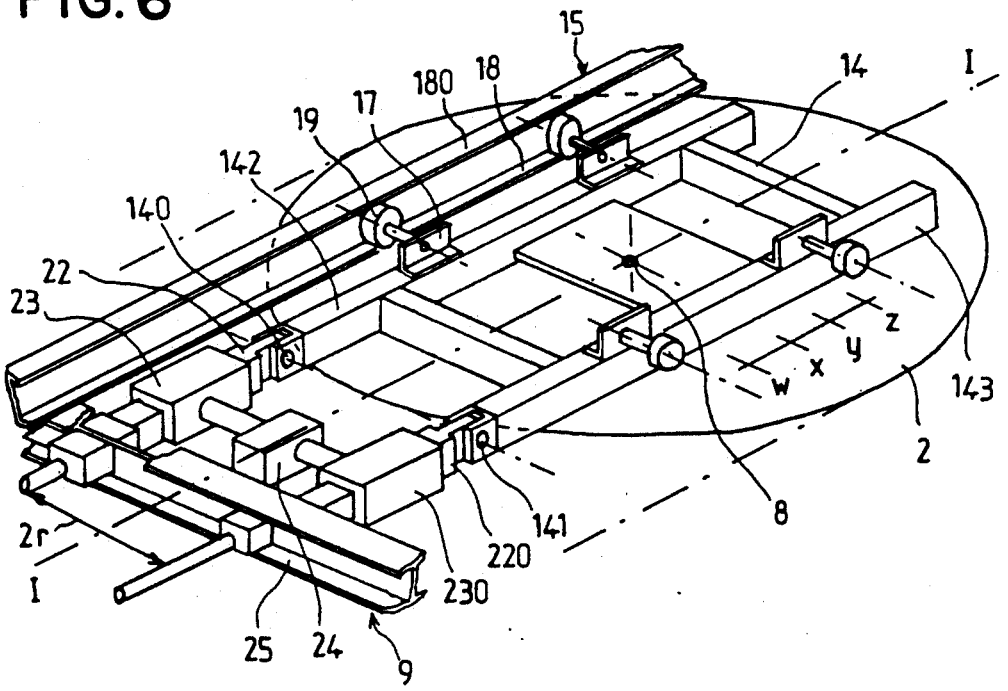
FIG. 7 is a partial perspective schematic view of the means supporting the drive pulley in a second embodiment of the invention.

In the embodiment shown in FIG. 7, the longitudinal sliding of carriage 14 is promoted by providing on the sliding lugs 17 rollers having a transverse axis such as roller 19, which bear between two longitudinal horizontal walls 18 and 180 of the guide, such as guide 15.

In a simplified embodiment, carriage 14 is retained by a single retention stop limiting its longitudinal movement against the overall tractive force exerted by the cable, the longitudinal guides 15, 16 absorbing the torsion forces.

In the preferred embodiments which have been shown, carriage 14 is retained by two stops 22 and 220, themselves retained by the fixed frame 9 and offset laterally with respect to the mean longitudinal direction I—I of the cable. For example, the two stops 22 and 220 are disposed symmetrically on each side of the mean direction I—I of the cable, and separated from each other by a distance 2r.

In the embodiments shown, stops 22 and 220 are each in the form of a tenon, each having a transverse shaft respectively 140 and 141 passing through the two arms of a fork formed at the forward longitudinal end of a lateral side member respectively 142 and 143 of carriage 14, as shown.

Each of the shafts 140 and 141 is provided with stress gauges for measuring the longitudinal force applied on each stop by carriage 14. For example, the dynamometric shafts with stress gauges described in the patent EP-A-059295 may be used, dimensioned so as to withstand and measure the forces produced by the tension of the cable on pulley 2. The signals produced by the stress gauges are fed to a computing and control assembly, as will be described further on.

Preferably, the spacing 2r between stops 22 and 220 is chosen so that, under all operating circumstances, the forces exerted by carriage 14 on the stops remain unidirectional, directed towards the other pulley 61.

Figure 2:
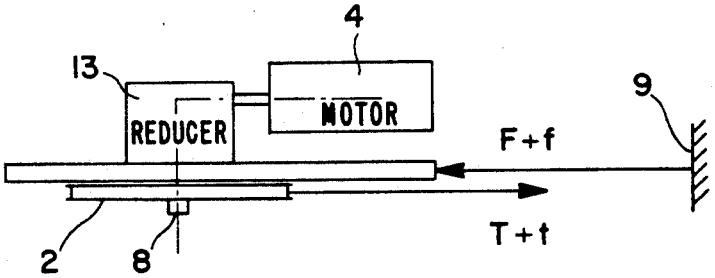
FIG. 2 is a schematic side view of the drive station for the installation of the invention.
Figure 3:
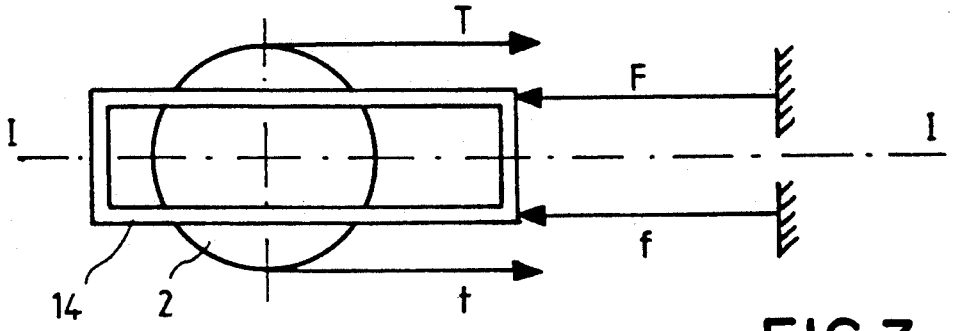
FIG. 3 is a schematic top view of the station of FIG. 2, during the test phase.

In FIGS. 2 and 3, the diagram of the forces has been shown schematically when the installation is shut down. The first cable side produces a tension T on the pulley 2 whereas the second cable side produces a tension t on pulley 2. The tensions T and t are transmitted by pulley 2 to carriage 14. Stops 22 and 220, when retaining carriage 14, produce respective reaction forces F and f. When stopped, the tensions T and t are equal to each other, the forces F and f are equal to each other, opposite the tensions T and t and of the same value as them, when the stops are symmetrical with respect to the axis I—I.

Figure 4:
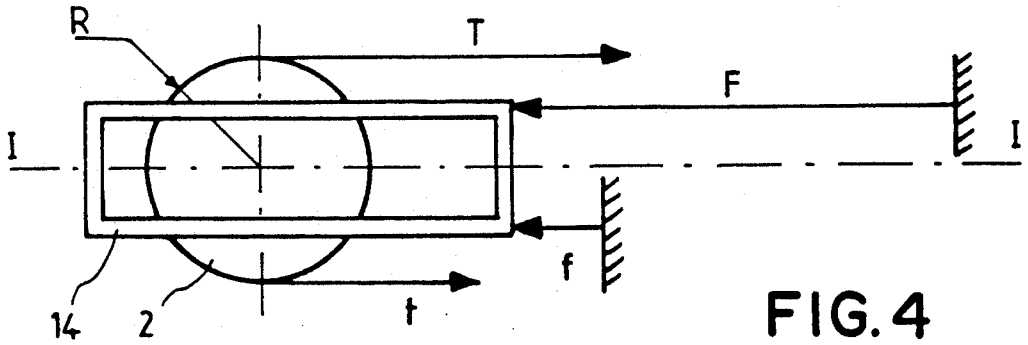
FIG. 4 is a top view of the drive station of FIG. 2, during a traction period.

In FIG. 4, the diagram of forces has been shown during traction operations. The first cable side pulled by pulley 2 opposes a tension T greater than the tension t of the second cable side leaving pulley 2. The overall tension of the cable is equal to the sum of tensions T and t and it is balanced by the retention forces of stops 22 and 220, so that the sum of the retention forces F and f of the two stops is equal to the sum of the tensions T and t of the cable. Thus, by measuring the sum of the signals produced by the stress gauges of stops 22 and 220, the overall tension of the cable may be known, either when stopped as shown in FIGS. 2 and 3, or in operation as shown in FIG. 4.

Figure 5:
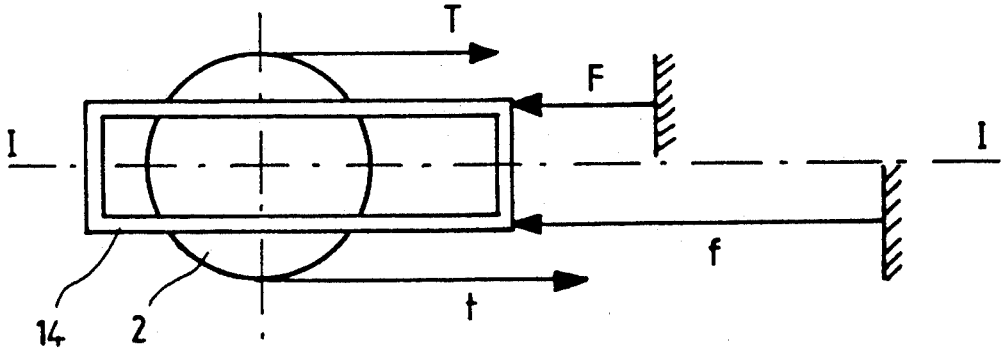
FIG. 5 shows schematically in a top view the traction station during a braking period.

In FIG. 5 the diagram of the forces has been shown in the case of operation during braking. In this case, the tension t of the outgoing cable side is greater than the tension T of the cable side entering pulley 2. The sum of the retention forces F and f of stops 22 and 220 is equal to the sum of the tensions T and t of the cable sides.

During traction or braking, the torque produced on shaft 8 of pulley 2 introduces differences between the tensions T and t of the two cable sides. By reaction, this torque also produces a difference between the forces F and f exerted by stops 22 and 220. The moment of tensions T and t is equal to and the reverse of the moment of forces F and f. Thus, by measuring separately F and f, the tensions T and t of the cable sides may be derived by simple calculation, taking into account the radius R of the pulley and the distance 2r between stops. These possibilities of measuring the tensions are used in the present invention for monitoring and checking the safety conditions during operation.

In the embodiment of FIG. 7, the device further comprises means for adjusting the longitudinal position of carriage 14 with respect to the fixed frame 9 during the rest phases, and for maintaining this position fixed during the working phase. For that, stops 22 and 220 are mounted on a frame whose longitudinal position is adjustable by means of a jack or another adjustable device. For example, stop 22 is mounted on a screw jack 23, stop 220 is mounted on a screw jack 230 the two jacks 23 and 230 being controlled for example by a geared motor 24, so as to adjust the longitudinal distance between stops 22 and 220 and the fixed cross-piece 25 of frame 9. Position sensors may also be provided for detecting the longitudinal position of stops 22 or 220 with respect to frame 9, detecting for example four longitudinal positions w, x, y and z.

Figure 8:
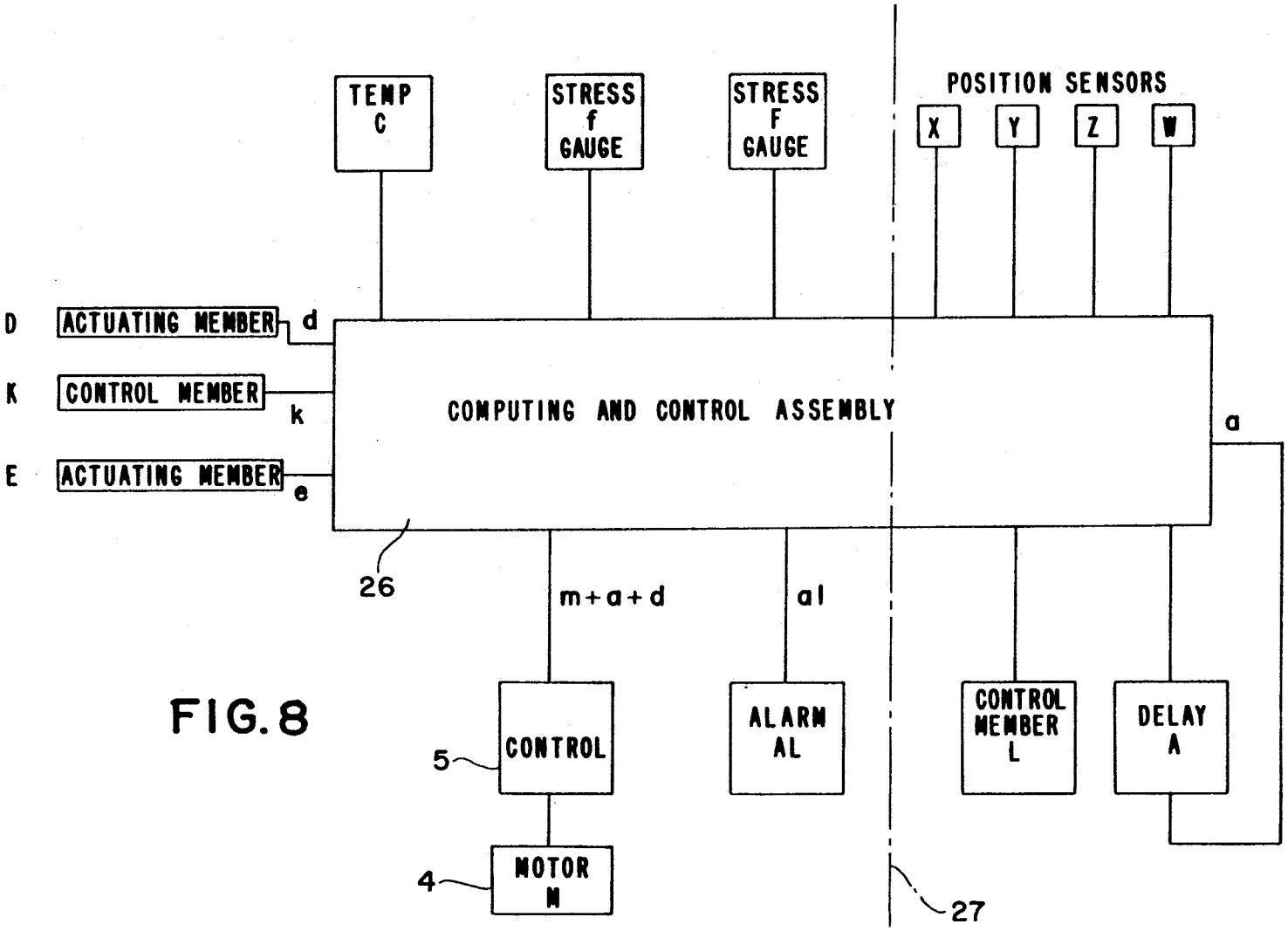
FIG. 8 shows schematically the checking and computing means of the invention.

In FIG. 8 have been shown the main computing and control elements according to the invention. These elements comprise a computing and control assembly 26, formed of a programmable automaton of the type able to carry out the functions which will be described hereafter. The inputs of the programmable automaton 26 receive the signals produced by the stress gauges disposed in stops 22 and 220, namely the signals F and f. The programmable automaton also receives, in an improved embodiment, the signals produced by a temperature sensor C. A control member K, which can be actuated by means of a key entrusted to the chief operator feeds to the programmable automaton 26 a signal k for re-starting operation of the installation after shutdown on a fault. An actuating member E, which can be operated by the user, delivers to the programmable automaton 26 the information e according to which the user requests execution of the test step. A second actuating member D, which can be operated by the user, may be provided in certain embodiments. In this case, the user must actuate member D after reading the information resulting from the test step and thus produce a start-up signal d fed to the programmable automaton 26. Member D is however not indispensable, and it may be omitted in some embodiments. The programmable automaton 26 delivers, at a first output, a signal m which is fed to the control members 5 of the main motor 4 of the installation, for ordering operation or stopping. At a second output, the programmable automaton 26 produces a signal al which is fed to the signalling means AL for warning the user of a malfunction in the system.

In FIG. 8, at the right of the broken line 27, have been shown the members used in the improved embodiments of the invention, namely: position sensors x, y, z and w giving the relative longitudinal position of stops 22 and 220 or of carriage 14 with respect to the fixed frame 9; a control member L, driven by the programmable automaton 26, for actuating the gear motor 24 shown in FIG. 7; a delay A for selecting the start-ups, depending on whether they require a test procedure or not and delivering a signal a at the end of a predetermined time following reception of a signal from the programmable automaton 26.

The programmable automaton 26 is programmed so as to produce operation such as will be described below in connection with four successive embodiments.

In all the embodiments, operation takes place in two successive distinct phases, namely a test phase and an operating phase. The steps of each of the phases are shown schematically in the graphs of FIGS. 9 to 12.

The operating phases are identical in the four embodiments and take place following the previous test phase during which a more or less large number of parameters are tested, depending on the embodiment considered.

During the operating phase, the programmable automaton 26 carries out permanently a checking cycle comprising the following steps:

during step 1, the programmable automaton reads the tension value applied to the force sensor or sensors of stops 22 and 220;

during step 21, the programmable automaton 26 carries out an operation V for checking the force values measured with respect to a minimum predetermined threshold and a maximum predetermined threshold. The maximum threshold and the minimum threshold are predetermined as a function of the geometry and structural data of the installation, during construction thereof, taking the safety coefficients applicable and operating assumptions into account If required, during this step, the values of forces measured are displayed according to procedure I.

If the values measured are between the minimum threshold and the maximum threshold, the programmable automaton 26 begins step 1 again.

If the values measured are not between the minimum threshold and the maximum threshold, the programmable automaton undertakes steps 31*a, b* during which it orders stopping of the main motor 4 of the installation, by the procedure M− and it orders actuation of the alarm AL by the procedure AL2, indicating that the tension of the cable exceeds the specified range.

The installation remains in this condition until the operator intervenes. If the chief operator introduces his key in device K, producing a signal k at the corresponding input of the programmable automaton 26, the latter starts steps 41*a, b* during which alarm AL is stopped and the operation of the installation is prohibited, according to procedure A−. The programmable automaton 26 returns then to step 1 to begin a test phase.

Figure 9:
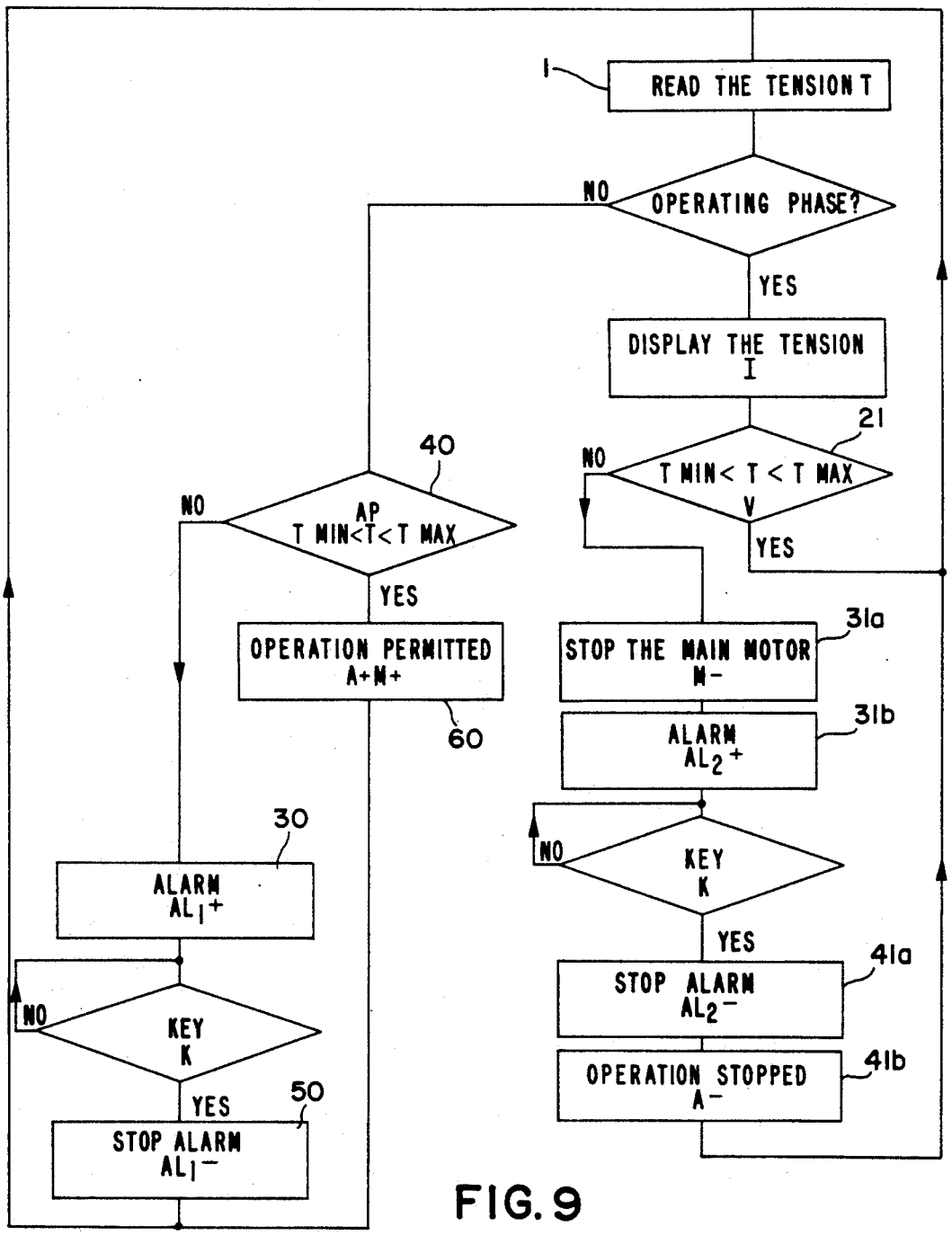
FIGS. 9 to 12 show in four different embodiments the operating steps of the computing and control assembly of FIG. 8.

In the embodiment illustrated in FIG. 9, the test phase comprises the following steps:

step 1 for measuring the force values is identical to that of the operating phase. The programmable automaton 26 then undertakes step 40, during which it carries out a program AP for checking the tension of the cable. In this embodiment, the programmable automaton compares the values measured at the stress gauges of the stops of carriage 14 with two maximum and minimum limit values; the maximum and minimum limit values are chosen by calculation so that the installation operates reliably normally, under the appropriate safety conditions, namely without loss of adherence and without reaching the maximum cable tension threshold, during the working phase which follows the test phase, under the usual operating assumptions.

If the result ap of the comparison shows that the values measured are between the maximum and minimum limit tension values, the programmable automaton 26 undertakes step 60 during which it produces a starting order m for the main motor 4 of the installation, according to procedure M+ and allows as a whole operation of the installation according to procedure A+ delivering the signal a. It then returns to step 1 of the operating phase. The main motor 4 operates when the three signals m, a and d are produced simultaneously.

On the other hand, if the comparison shows that the tension values measured are not between the maximum and minimum limit values, the programmable automaton undertakes step 30 so as to produce an alarm signal according to the procedure AL1 and the installation remains in this condition until the operator intervenes.

If the operator inserts his key in device K, producing a signal k fed to the programmable automaton 26, the latter undertakes step 50 in order to stop the alarm according to the procedure AL− and returns to the test step 1.

In the absence of a go-ahead signal a, the programmable automaton 26 prevents all operating phases from being undertaken before a test phase has been carried out, following which the procedure A+ produces the operating go-ahead signal a. In the embodiments in which A is a delay, the signal a is maintained for a predetermined time following start-up or stopping of the installation. Thus, it is certain that the test phase is only carried out when the installation is under the required load conditions.

Figure 10:
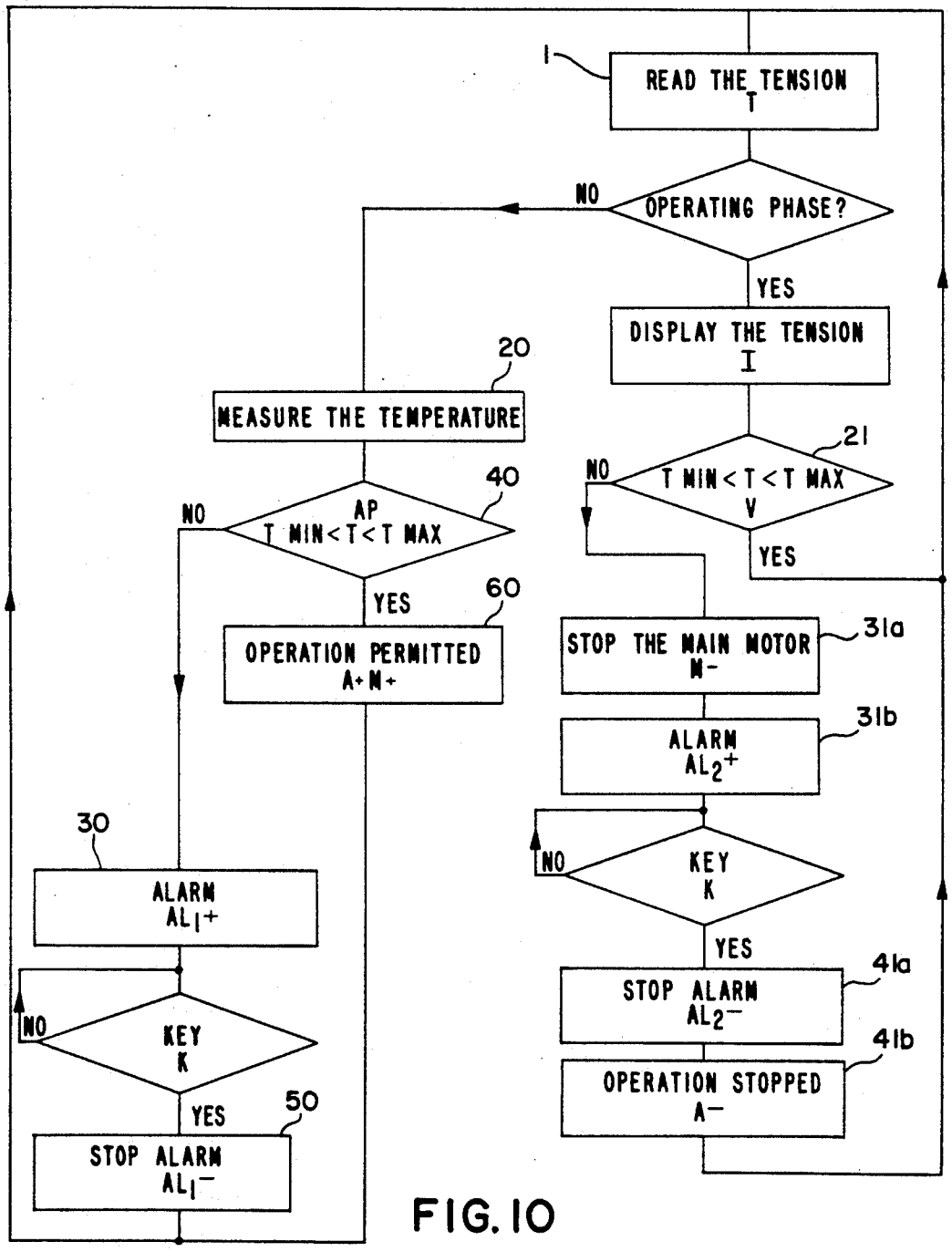

In the embodiment of FIG. 10, the test phase further comprises an intermediate step 20, between the measurement step 1 and the comparison step 40, during which the programmable automaton 26 reads the value of the signal produced by the temperature sensor C. The temperature value thus measured makes it possible to modify the comparison then carried out in step 40, for example by modifying the range defined by the limit tension values of the cable. If for example the temperature measured is very low, for winter operation, the limit temperature values must be taken into account because the temperature risks rising during the working period following the test phase. Similarly, if the temperature measured is relatively high, during summer working, this data must be taken into account for calculating the admissible tension limit values of the cable. In fact, when the cable travels over two fixed pulleys 61 and 2, in accordance with the invention, this tension measured off load during the previous test phase depends on the temperature, by the effect of the thermal expansion coefficient of the cable.

Figure 11:
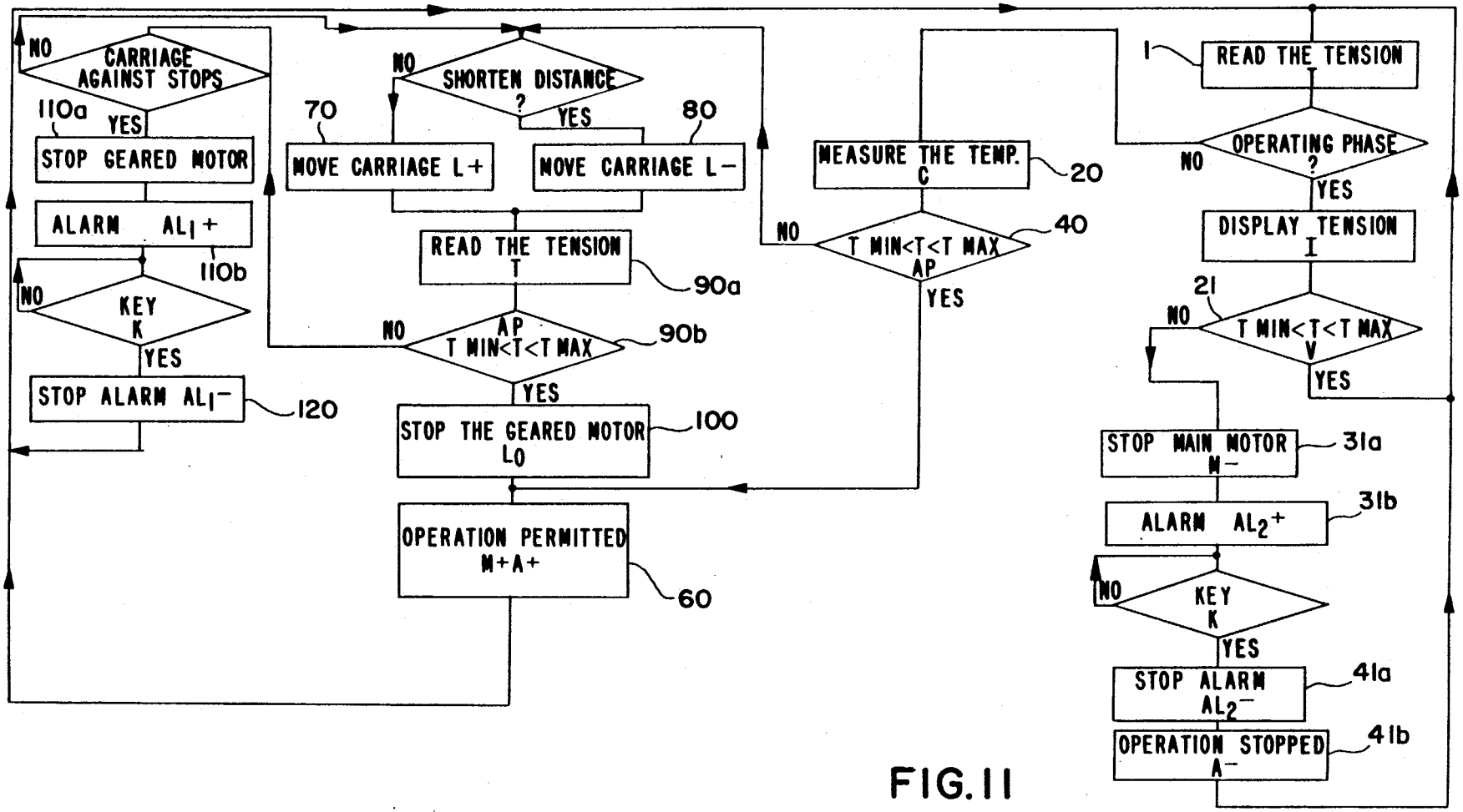

In the embodiment illustrated in FIG. 11, the control means are adapted for use with an embodiment shown in FIG. 7, in which the longitudinal position of carriage 14 may be modified as a function of the creep of the cable. The creep of the cable produces a permanent extension which, if pulleys 61 and 2 remain fixed, tends to progressively decrease the tension of the cable at rest. This tension thus risks becoming less than the minimum allowed value and it may be brought back to the normal tension range by moving carriage 14 away from pulley 61. On the other hand, shortening of the cable may mean moving the carriage 14 in the direction of pulley 61. The operations for moving carriage 14 are controlled by the programmable automaton 26 according to the procedure illustrated in FIG. 11. If it seems necessary during the check carried out during step 40, to extend the distance between the two pulleys 61 and 2, the programmable automaton 26 undertakes step 70 and procedure L+, for controlling the operation of the gear motor 25 for incrementing the position of carriage 14. On the other hand, if it is necessary to shorten the distance, the programmable automaton 26 undertakes step 80 and procedure L−. Then, the programmable automaton 26 undertakes steps 90*a, b*, during which it again measures the tensions of the cable and it undertakes program Ap similar to that of step 40. If the result of the comparison is correct, the programmable automaton 26 then undertakes step 100 for stopping the gear motor and step 60 for starting up the main motor and permitting operation of the installation. If not, the programmable automaton undertakes steps 110*a, b*, during which it stops the gear motor and produces an alarm signal indicating that the adjustment of position of carriage 14 is now insufficient. During step 120, the user may insert a key so as to resume operation of the device and stop the alarm.

Figure 12:
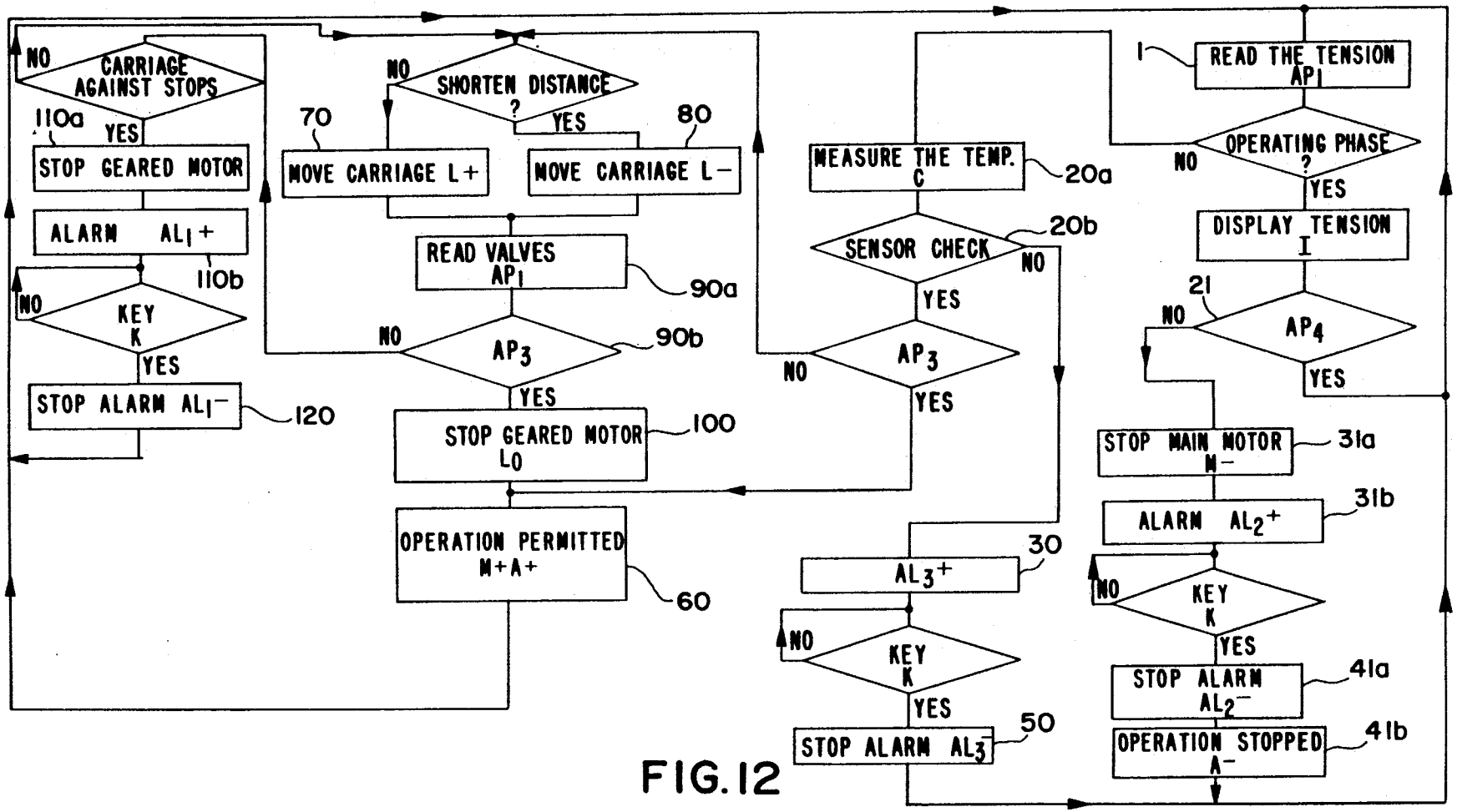

In the more complete embodiment of FIG. 12, the device comprises two force sensors, namely a sensor for each of stops 22 and 220 measuring the forces F and f on each of the sensors.

In this embodiment, during step 1, the programmable automaton 26 further carries out the program Ap1 during which it calculates the tensions T and t of the cable. During steps 20*a, b*, the programmable automaton 26 reads the temperature measured by sensor C and carries out the program Ap2 in which it calculates the ratio F/f and checks that this ratio is close to 1. This step, carried out off load during the test phase, makes it possible to check the correct operation of the two sensors of stops 22 and 220: if the result of the ratio is very far from 1, that means that one of the two sensors at least is defective. In such a case, the most erroneous value between the measurements F and f will be eliminated and the calculations will be made without taking it into account.

During step 40, the programmable automaton carries out program Ap3, similar to program Ap of the preceding embodiments. The subsequent steps 60, 70, 80, 90*a, b*, 100, 110*a, b*, 120 are similar to those of the embodiment of FIG. 11.

If the programmable automaton 26, during program Ap2 of steps 20*a, b*, determines that one of the sensors is defective, it undertakes step 30 and produces an alarm signal A13 indicating that a sensor is defective. The operator may interrupt the alarm signal by inserting his key in the appropriate device delivering signal k, during step 50.

In the working phase, during step 21, the programmable automaton 26 carries out program Ap4 which calculates and compares, with admissible thresholds, the following parameters in parallel:

the torque (T−t) as a function of time and the torque (T−t) with respect to its threshold values, on the one hand under maximum traction torque and on the other under maximum braking torque;

adherence of the cable on pulley 2; the adherence is obtained when the ratio of the tensions T and t is less than the value $e^{0.9f\alpha}$ in which $\alpha$ is the winding angle of the cable on the pulley, f is the friction coefficient between the pulley and the cable; in usual values, the friction coefficient is generally 0.3 and the winding angle is equal to $\pi$, which leads to a value of about 2.34 for the limit ratio between tensions T and t;

the range T+t minimum and T+t maximum, between which the sum T+t of the cable tensions must be situated;

the force F as a function of time or the force f as a function of time in the case of a defective sensor; examination of the variation of the forces as a function of time giving information on the variation of the tensions T and t as a function of time makes it possible to detect malfunctions of the installation and produce alarm or shut-down signals.

In the case of a defect in the checking program Ap4, the programmable automaton 26 undertakes steps 31*a, b*, produces an alarm signal and orders shut-down of the motor, as in the preceding embodiments.

The control and checking steps according to the invention may be effected automatically, for example during start-up of the installation every morning. When the operator wishes to start up the installation, the programmable automaton 26 begins systematically by a test phase, the installation being off load and stopped. If the test phase gives a favorable result, with the set of quantities measured in the admissible ranges, it allows beginning of the working phase by procedure A+. It should be noted that the test phase must be carried out always under the same load conditions, preferably off load and stopped. Now, during working, it may happen that the installation has to be stopped and then started up again. To prevent the programmable automaton 26 from beginning a new test step at each start-up, which would risk giving erroneous test results, the installation being then on load, a delay A may be introduced in the programmable automaton 26, so that it only undertakes the test step after a given waiting time during which the installation is stopped.

The present invention is not limited to the embodiments which have been explicitly described but includes the different variants and generalizations thereof contained within the scope of the following claims.

We claim:

1. Cable transport installation having an operating phase and a test phase comprising:

a first pulley and a second pulley, around which travels a closed loop formed of a carrier-tractive cable or a tractive cable, at least one of the two pulleys being driven by a motor controlled by control means, to shaft of the first pulley attached to a first fixed frame of the installation, a shaft of the second pulley retained by a second fixed frame of the installation, characterized in that it comprises:

retaining means maintaining the shaft of the second pulley in a substantially constant position on the second fixed frame of the installation during the operating phase of the installation, said retaining means including means for adjusting the position of the second pulley shaft only during the test phase of the installation, means for measuring the tension of the cable and producing a signal which is the image of said cable tension, the signal being applied to an input of a computing and control assembly, a computing and control assembly receiving the signal produced by means measuring the tension of the cable, comparing said signal repeatedly with a predetermined minimum threshold and a predetermined maximum threshold and producing at its output an alarm signal when the tension measurement is less than the minimum predetermined threshold or exceeds the maximum predetermined threshold.

2. Installation as claimed in claim 1, wherein the computing and control assembly further produces, at its output, a stop signal fed to the control means of the motor for causing the installation to stop when the tension measurement signal is short of the predetermined minimum threshold or exceeds the maximum predetermined threshold.

3. Installation as claimed in claim 1, wherein:

the second pulley is mounted for rotation on an independent carriage sliding longitudinally over lateral guides of the fixed frame substantially parallel to the mean traction direction of the cable, retainer stop means are provided on the fixed frame for retaining the independent carriage and for limiting its longitudinal movement against the tractive force exerted by the cable and the pulley and by the independent carriage, at least one force sensor is inserted in the chain of elements between the pulley and the fixed frame for measuring the force retaining the carriage exerted by the retention stop means, the forces producing a signal which is the image of the cable tension, this signal being delivered to the computing and control assembly.

4. Installation as claimed in claim 3, wherein:

the independent carriage is retained by two stops, offset laterally with respect to the mean direction of the cable, the independent carriage is guided by vertical guide means allowing longitudinal movement and lateral pivoting thereof parallel to the plane defined by the two cable sides leaving the pulley, a first force sensor is associated with the first stop, a second force sensor is associated with the second stop, the signals of each of the two force sensors are fed to the computing and control assembly, so that the computing and control assembly computes the cable tension, the relative tension of the two cable sides and the torque produced by the pulley.

5. Cable transport installation having an operating phase and a test phase comprising:

a first pulley and a second pulley, around which travels a closed loop formed of a carrier-tractive cable or a tractive cable, at least one of the two pulleys being driven by a motor controlled by control means;

a shaft of the first pulley attached to a first fixed frame of the installation;

means for measuring the torque on the drive pulley;

computing means for comparing the torque with an adherence threshold and producing a control or alarm signal if the threshold is reached or exceeded;

a shaft of the second pulley retained by a second fixed frame of the installation;

retaining means maintaining the shaft of the second pulley in a substantially constant position on the second fixed frame of the installation during the operating phase of the installation;

means for measuring the tension of the cable and producing a signal which is the image of said cable tension, the signal being applied to an input of a computing and control assembly;

a computing and control assembly receiving the signal produced by means measuring the tension of the cable, comparing said signal repeatedly with a predetermined minimum threshold and a predetermined maximum threshold and producing at its output an alarm signal when the tension measurement is less than the predetermined minimum threshold or exceeds the predetermined maximum threshold.

6. Installation as claimed in claim 5, wherein said computing means determine the variation of the torque produced by the drive pulley as a function of time and compare this variation with thresholds for producing alarm or shut down signals.

7. Installation as claimed in claim 5, wherein said computing means determine the tension variation of at least one of the two cable sides as a function of time, compare this variation with an admissible threshold and produce corresponding alarm or shut-down signals.

8. Cable transport installation having a test phase and an operating test phase comprising:

a first pulley and a second pulley, around which travels a closed loop formed of a carrier-tractive cable or a tractive cable, at least one of the two pulleys being driven by a motor controlled by control means;

a shaft of the first pulley attached to a first fixed frame of the installation;

a shaft of the second pulley, mounted for rotation on an independent carriage of a second fixed frame, guided by vertical guide means allowing longitudinal movement and lateral pivoting thereof parallel to the plane defined by the two cable sides leaving the pulley;

two retainer stop means, which are provided on the second fixed frame and are offset laterally with respect to the mean direction of the cable, for:

a. retaining the independent carriage; and b. maintaining the shaft of the second pulley in a substantially constant position on the second fixed frame of the installation during the operating phase of the installation;

a first force sensor, associated with the first retaining stop means, and a second force sensor, associated with the second retaining stop means, which force sensors are located between the second pulley and the fixed frame for measuring the force retaining the carriage exerted by the retention stop means, the force sensors producing a signal which is the image of the cable tension, the signal being applied to a computing and control assembly;

means for measuring the tension of the cable and producing a signal which is the image of said cable tension, the signal being applied to an input of a computing and control assembly;

the computing and control assembly receiving the signals produced by each of the two force sensors and receiving the signal produced by means measuring the tension of the cable, which computing and control assembly:

a. computes the cable tension, the relative tension of the two cable sides and the torque produced by the pulley;

b. compares said signal produced by means measuring the tension of the cable repeatedly with a predetermined minimum threshold and a predetermined maximum threshold and delivers an operation enabling signal or operation disabling signal after the comparison;

c. produces at its output an alarm signal when the tension measurement is less than the predetermined minimum threshold or exceeds the predetermined maximum threshold; and d. is a programmable automation program for carrying out a previous test phase under predetermined load conditions, during which it compares the tension of the cable with two maximum and minimum limit values, the limit values being chosen so that the installation will operate normally, under appropriate safety conditions, without loss of adherence and without reaching the maximum cable tension threshold during the operating phase which follows the test phase, under the usual operating assumptions.

9. Installation as claimed in claim 8, wherein it further comprises an ambient temperature sensor whose signal is delivered to the computing and control assembly which takes it into account for carrying out the comparison, so that the range defined by the limit cable tension values may be determined with greater accuracy and may be reduced.

10. Installation as claimed in claim 8, wherein the computing and control assembly carries out a checking program by which it checks that the ratio between the signals delivered by two force measurement sensors is close to 1.

11. Installation as claimed in claim 8, further comprising means for adjusting, during the test phase, the longitudinal position of the independent carriage supporting the second pulley with respect to the fixed frame and for maintaining this longitudinal position fixed during the working phase.

12. Installation as claimed in claim 11, wherein the top means retaining the independent carriage are mounted on a frame whose longitudinal position is adjustable by means of jacks.

13. Installation as claimed in claim 11, further comprising sensors sensing the position of the independent carriage.

14. Installation as claimed in claim 11, wherein, during the test phase the means for adjusting the longitudinal position of the independent carriage are controlled by the computing and control assembly for moving the carriage in the direction bringing the overall tension of the cable back into the normal tension range, and then blocking the carriage during the working phase.

15. Installation as claimed in claim 14, wherein the computing and control assembly receiving the signals from carriage position sensors produces an alarm signal when the position adjustment is no longer possible and direct intervention on the cable or other structural parameter of the installation is necessary.

16. Installation as claimed in claim 8, wherein the computing and control assembly comprises a delay step A prior to any test phase.

* * * * *

UNITED STATES PATENT AND TRADEMARK OFFICE

CERTIFICATE OF CORRECTION

PATENT NO. : 5,134,571

DATED : July 28, 1992

INVENTOR(S) : Falque et al.

It is certified that error appears in the above—identified patent and that said Letters Patent is hereby corrected as shown below:

On the title page and Column 1, line 5, after "Alain Falque," change "Grenoble" to --Annecy--.

Signed and Sealed this

Fifth Day of October, 1993

Bruce Lehman

*Attest:*

BRUCE LEHMAN

*Attesting Officer*

*Commissioner of Patents and Trademarks*